US007398872B2

(12) United States Patent
Valterio et al.

(10) Patent No.: US 7,398,872 B2
(45) Date of Patent: Jul. 15, 2008

(54) DEVICE FOR ALIGNING PLATE-LIKE WORKPIECES IN A MACHINE PROCESSING THEM

(75) Inventors: Roberto Valterio, Ollon (CH); Philippe Vogt, Anthy (FR); Daniel Cugnoni, Corseaux (CH)

(73) Assignee: Bobst, S.A. (CH)

( * ) Notice: Subject to any disclaimer, the term of this patent is extended or adjusted under 35 U.S.C. 154(b) by 491 days.

(21) Appl. No.: 11/106,147

(22) Filed: Apr. 14, 2005

(65) Prior Publication Data

US 2005/0239623 A1 Oct. 27, 2005

(30) Foreign Application Priority Data

Apr. 21, 2004 (CH) ..... 0686/04

(51) Int. Cl.
*B65G 15/14* (2006.01)

(52) U.S. Cl. ..... 198/626.3; 198/861.2

(58) Field of Classification Search ... 198/626.2–626.6, 198/817, 860.1, 861.1, 861.2, 626.1
See application file for complete search history.

(56) References Cited

U.S. PATENT DOCUMENTS

| | | | | |
|---|---|---|---|---|
| 3,519,266 | A | 7/1970 | Blake et al. | 271/49 |
| 3,955,494 | A * | 5/1976 | Suzuki | 101/232 |
| 4,089,517 | A * | 5/1978 | Marass | 271/13 |
| 4,163,550 | A * | 8/1979 | Armstrong | 271/274 |
| 5,413,327 | A * | 5/1995 | Reymond et al. | 271/251 |
| 6,162,157 | A | 12/2000 | Morisod | 493/180 |

FOREIGN PATENT DOCUMENTS

| | | |
|---|---|---|
| CH | 678 707 | 2/1991 |
| EP | 0 610 791 | 8/1994 |

* cited by examiner

*Primary Examiner*—James R Bidwell
(74) *Attorney, Agent, or Firm*—Ostrolenk, Faber, Gerb & Soffen, LLP

(57) ABSTRACT

A device for aligning plate-like workpieces traveling in a machine direction in a machine processing them, more particularly in a folder-gluer, comprising an upper aligner and a lower aligner. The lower aligner is equipped, on the one hand with a guiding member mounted on a lower guide, and on the other hand with a lower conveyor having at least one useful portion which is fixedly attached to an upper guide movable in the horizontal plane with respect to the lower guide. The lower and upper guides form a bearing element unit, which is weakened by an opening extending between the guides.

10 Claims, 3 Drawing Sheets

DEVICE FOR ALIGNING PLATE-LIKE WORKPIECES IN A MACHINE PROCESSING THEM

BACKGROUND OF THE INVENTION

The present invention refers to a device for aligning plate-like workpieces in a machine processing them, more particularly in a machine manufacturing packaging such as a folder-gluer.

Such a machine is commonly used for manufacturing, for example, cardboard boxes from plate-like workpieces also called box blanks. These plate-like workpieces generally result from the diecutting of a sheet or a web by another machine in a series of preceding operations. A folder-gluer generally comprises a succession of modules, each carrying out a determined operation so that the blanks, introduced at the machine entry, leaves in the shape of folded boxes ready to use. To this end, a folder-gluer generally comprises a feeder supplying the machine with box blanks from a pile of blanks. The conveying of these blanks into the various modules of the machine is carried out by a belt conveyor which, via friction, seizes the blanks, either between lower and upper belts or between lower belts and upper pressure rollers. Typically, the operations carried out in the machine are: the prebreaking of certain folding lines of the blank, the folding of certain parts, the gluing of the glue tabs, the pressing of the folded and glued blanks and their delivery at the end of the production line.

To achieve an accurate folding along the creasing lines provided for this purpose on each blank, it is necessary to correctly introduce these blanks into the machine and then to prevent any sliding during their transport. Thus, the first problem the skilled man is faced with is that of the introduction of these blanks into the machine. Effectively, it is essential that their position laterally as well as longitudinally is in perfect register with the previous folding members. Thus, the sequential feeding of the blanks into the machine is carried out from a pile from which the plate-like workpieces are drawn off one by one from the bottom of the pile. The blanks are driven forward by friction of the belts on each blank located in turn at the bottom of the pile whereas a front gauge in front of the pile defines a just sufficient space, between its lower edge and the plane of the conveyor, so that only one blank can there be introduced at the same time. The box blank in the course of introduction temporarily blocks the space between the lower end of the gauge and the surface of the belt conveyor in order to prevent departure of the next blank until the rear edge of the blank in the course of introduction has left the space under the gauge. Due to the fact that the frictional force between the blank at the bottom of the pile and the belts is much greater than that between two blanks, even the blanks located at the bottom of the pile, the introduction can be controlled perfectly. However, these friction forces naturally generate wear of the blanks causing cardboard dust which finally dirties the driving belts and can influence the adherence of the plate-like workpieces. According to the size of the box blanks, a plurality of belts may be arranged parallel to one another in order to ensure transport of the blanks. However, due to the dirt accumulation of these belts, an imbalance of the frictional forces between the plate-like workpiece and each of these belts is possible. These differences in the forces create a moment which, when applied on the blank, will tend to turn it in the horizontal plane and therefore to introduce it askew in an incorrect orientation.

Aligning devices are used to correct this problem, which force each badly introduced blank to align along a reference line in a correct orientation. This aligning operation is obviously carried out before the prebreaking of the blank folds. To carry out such an operation, it is known to use the drive of a belt placed slightly askew with respect to the longitudinal axis of the machine so as to force the blanks to align against a longitudinal reference edge. U.S. Pat. No. 3,519,266 describes a feed table equipped with an endless belt for driving sheets of paper or cardboard. The arrangement of this belt is such that it defines an acute angle between its orientation and the longitudinal edge of the machine. Owing to this oblique orientation, the sheets are driven, before leaving the feed table, towards a support rule parallel to the longitudinal edge of the machine. Thus, all the sheets can be aligned on the feed table along this support rule. In order to ensure a sufficient friction between the sheets and the belt, a plurality of pressure rollers are arranged along a bar placed above the driving belt. The whole is arranged in a carriage which is movable in the lateral direction so as to be adaptable to the various possible sheet sizes. The orientation of the belt can vary owing to the arrangement of a bearing supporting one of the end pulleys of the driving belt and swivelling around a vertical axis. The bar supporting the pressure rollers is also swivelling so that it can be oriented according to the same angle than that of the driving belt.

Swiss Patent CH 678,707 describes another device for aligning box blanks comprising a movable longitudinal guiding rail, a lower endless belt driven and supported by rollers, and a succession of upper rollers, each mounted swivelling vertically and horizontally so that it is not only possible to lower or raise each roller in order to adjust the pressure on the blank, but also to independently orient each of them in a chosen direction. Having numerous adjustment possibilities, this device has the drawback of being particularly expensive and complicated to realize. Moreover, due to the numerous adjustment possibilities, it can require the device be handled a relatively long time.

Another device for aligning box blanks is described in EP 610,791. In addition to a longitudinal guiding rail fixedly attached to a fixed part of the frame, this device comprises a lower conveyor mounted on a lower longitudinal bar and, in correspondence, an upper conveyor secured by adjusting means to an upper longitudinal bar. A bracket connects the lower longitudinal bar to the upper longitudinal bar so that the angular adjustment of the lower and upper conveyors can be carried out simultaneously. To this end, one of the ends of the lower longitudinal bar is mounted swivelling in the horizontal plane on a fixed part of the frame by means of a pivot with vertical axis. At the opposite end, a device comprising screws and threaded ring allows removing this end from the longitudinal guiding rail and hence to vary the angle of orientation of the pair of lower and upper conveyors with respect to the longitudinal reference axis.

The main problems of the previously described devices are on the one hand their production cost and on the other hand it is impossible to use them interchangeably on the left or on the right side of the machine. Effectively, according to the box type to be realized, the box blanks should sometimes be aligned on the left side of the machine rather than on the right side, in accordance with the position of the gluing tab of the blank. To enable this changeover, the machine should specifically be equipped with an aligning device designed for an alignment on the left side, for example, whereas in most cases, the alignment is made on the right side of the machine with respect to the traveling direction of the blanks. However, due to their design, currently known devices cannot be used for aligning blanks at choice on the left or the right side of the machine. In the device illustrated in EP 610,791, this impossibility is due to the fact that the pivot point is arranged beside a vertical base plate, at half height of that one, being used as fixed structure for the aligning device. Due to this fact, the lower conveyor can be removed only on one side from the vertical base plate and can thus align only on the right side or only on the left side according to its design. Effectively, it is precisely because of its design, namely the arrangement and the space requirement at the same time of its bearing structure, the return rollers and the path of the belt, that the aligner members of such an aligning device cannot be positioned angularly on one side or the other according to the needs.

SUMMARY OF THE INVENTION

The aim of the present invention is to overcome these main drawbacks by proposing an aligning device which is in particular more economic to manufacture, simpler to realize and which can be used indifferently for an alignment called on the right or on the left while only requiring a minimum of handling to realize such an inversion.

This aim is achieved owing to the present invention of a device for aligning plate-like workpieces traveling in a machine direction in a machine processing them, more particularly in a folder-gluer. The device comprises an upper aligner and a lower aligner. The lower aligner is equipped, on the one hand with a guiding member mounted on a lower guide, and on the other hand with a lower conveyor having at least one useful portion which is fixedly attached to an upper guide movable in the horizontal plane with respect to the lower guide. The lower and upper guides form a bearing element unit, which is weakened by an opening extending between the guides.

Other features and advantages of the present invention will become apparent from the following description of the invention which refers to the accompanying drawings.

BRIEF DESCRIPTION OF THE DRAWINGS

The invention will be more clearly understood from the study of a preferred embodiment given by way of non-limitative example and illustrated by the accompanying drawings, in which.

DESCRIPTION OF A PREFERRED EMBODIMENT OF THE INVENTION

The pairs of FIGS. 1*a*, 1*b* and 2*a*, 2*b* perspectively illustrate a device 1 for aligning plate-like workpieces, not shown, as seen from the side opposite the operator's side and from the operator's side of the machine, respectively. The arrow F shows the traveling direction of the plate-like workpieces and also defines the upstream and downstream sides of the device 1 by specifying that the plate-like workpieces always travel from upstream towards downstream. The definition of this terminology avoids as much as possible the use of the terms left-right and front-rear which have the drawback of depending on the observer's position with respect to the considered machine. It is also to be noted that the adjectives longitudinal and lateral or transverse, as well as the derived adverbs, refer to the position of parts respectively oriented in the direction upstream-downstream and in the direction operator's side—opposite operator's side.

As illustrated in the enclosed drawings, the device 1 is adapted to align the plate-like workpieces on the side opposite the operator's side of a folder-gluer, namely for a correction also called for on the right. Besides, the folder-gluer has not been represented in the enclosed drawings, since it is not part of the present invention and is not necessary to the understanding of the device 1. Moreover, illustrating the device 1 of the present invention in a configuration for aligning on the side opposite the operator's side rather than on the operator's side is due to the fact that most alignments of plate-like workpieces are carried out on the right. Nevertheless, the right-left inversion of this configuration will be explained afterwards in the description which will follow.

Figures 1A, 1B:
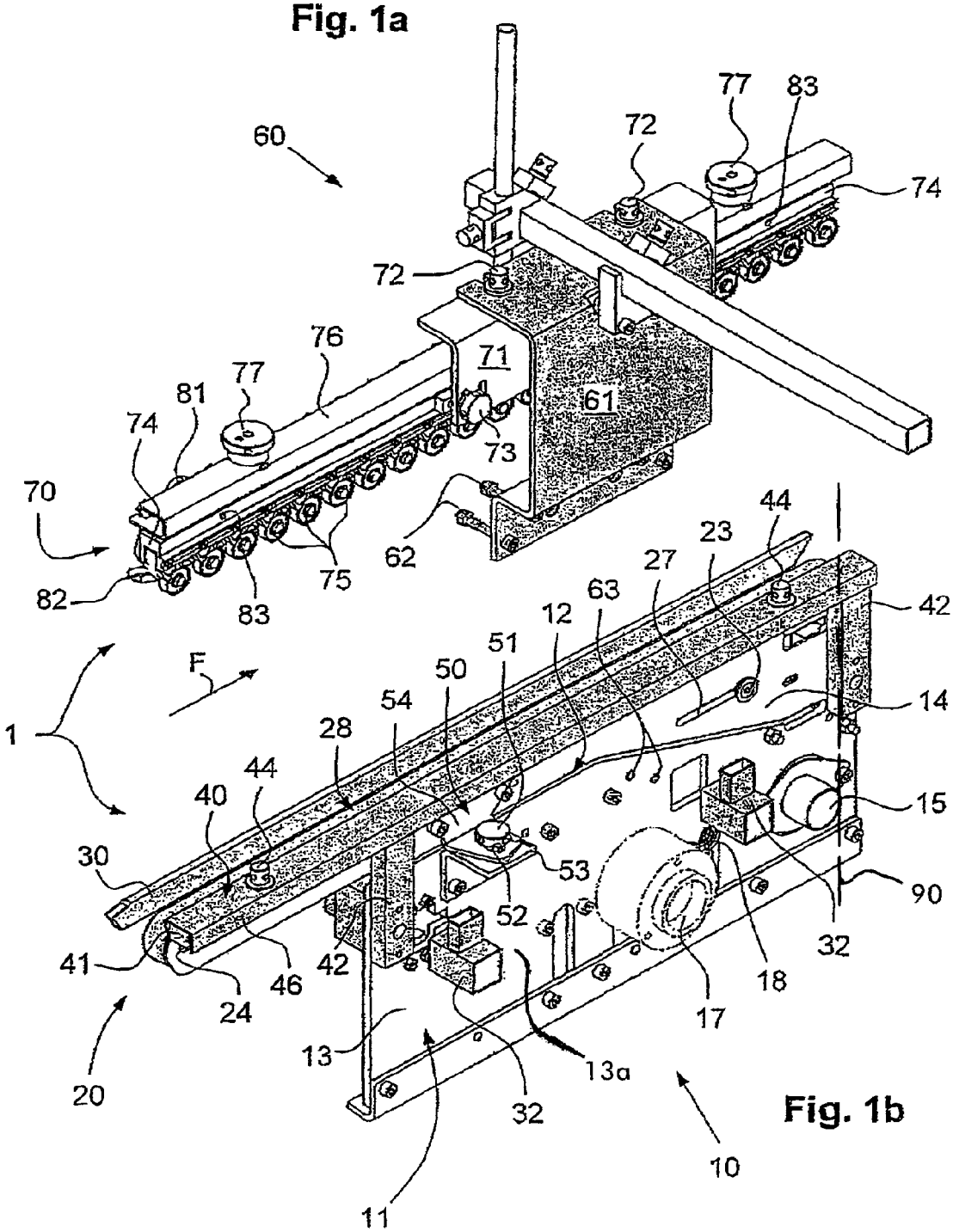
FIGS. 1*a* and 1*b* are perspective views of the aligning device of the present invention, respectively of an upper aligner member and a lower aligner member seen from the side opposite the operator's side.
Figures 2A, 2B:
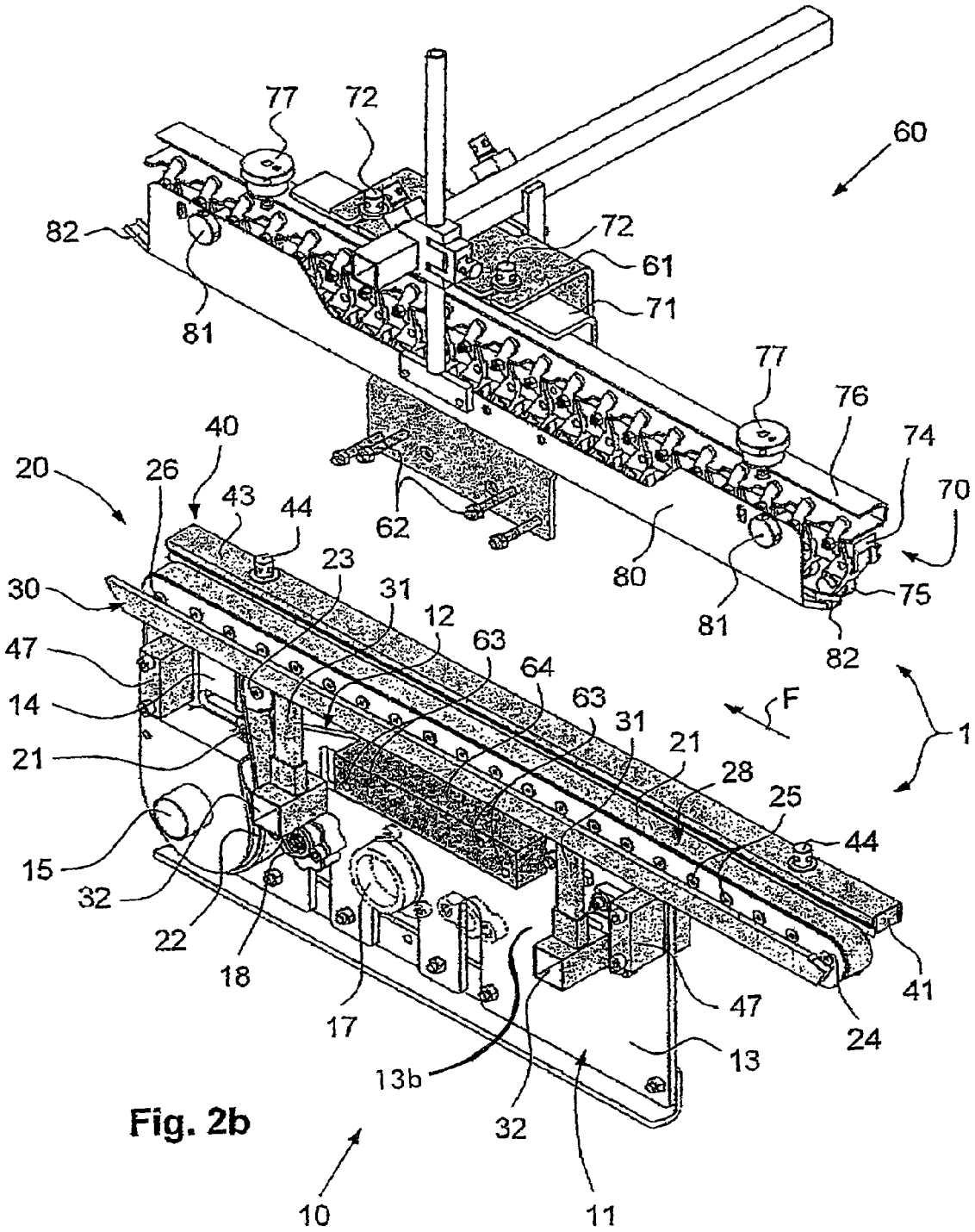
FIGS. 2*a* and 2*b* are views from the operator's side of FIGS. 1*a* and 1*b* respectively.
Figure 3:
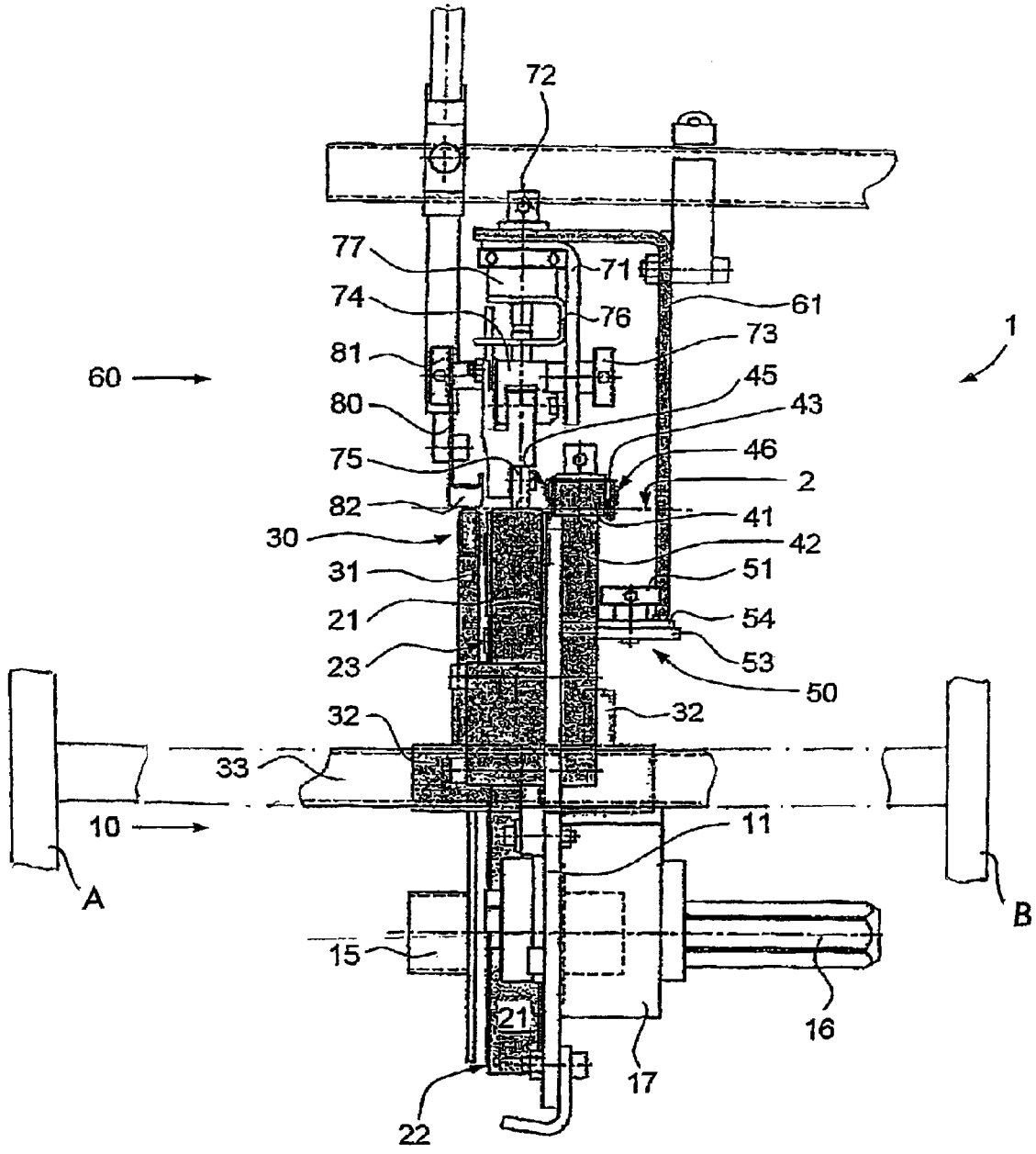
FIG. 3 is a side view of the assembled upper and lower aligner members seen according to the arrow F of the preceding drawings.

The aligning device 1 comprised of two different parts, one of which is illustrated in FIGS. 1*a*, 2*a* and the other in FIGS. 1*b*, 2*b*. Thus, FIGS. 1*b* and 2*b* show a lower aligner member 10 corresponding to the lower part of the device 1, and FIGS. 1*a* and 2*a* show an upper removable aligner member 60 corresponding to the upper part of this same device 1. Such as shown in FIG. 3 by a horizontal dot-and-dash line, the traveling plane 2 of the plate-like workpieces is located between the lower 10 and the upper 60 aligner members.

Firstly, the lower aligner member 10 will be described with reference to FIGS. 1*b*, 2*b* and 3. It comprises a bearing element 11 comprised of a vertical plate used as frame for the various component parts of the lower aligner member 10. The bearing element 11 is made of two different parts delimited by an opening 12 provided along a preferred line which is more or less horizontal so that it determines a lower guide 13 and an upper guide 14. The lower and upper guides thus form parts of a single bearing element which can be described as a unit since it is materially indivisible. Preferably, the lower guide 13 of this bearing element 11 has a larger surface than the surface of the upper guide 14. In the lower guide 13 is arranged a centering member 15. Through that member extends a hexagon shaft 16, shown in FIG. 3. This shaft 16 allows a drive pulley 22 to rotate, as better shown in FIG. 2*b*, around which turns an endless belt 21 of a lower conveyor 20 for driving the plate-like workpieces, not shown, from upstream towards downstream in the direction shown by arrow F. In order to enable positioning and laterally moving of the device 1 between the operator's side and the opposite operator's side of the folder-gluer, a guiding rail 17 is arranged in the lower guide 13. This guiding rail, or plain bearing, slides along a sliding shaft (not shown) connecting the operator's and opposite operator's sides of the folder-gluer. To allow lateral positioning of the device 1, a nut 18 is fixedly attached to the lower guide 13 and ensures the displacement of the whole device by rotation of an endless screw extending through this nut when the aligning device is arranged in the folder-gluer.

As better shown in FIG. 2*b*, the path of the belt 21 of the lower conveyor 20 runs around the drive pulley 22 then turns around at least one return pulley 23 before rising to the traveling plane 2 of the plate-like workpieces around an upstream axis return pulley 24, then remains at the level of this plane supported by a plurality of supporting rollers, only the rotational axes 25 of which are shown, and dips towards the drive pulley 21 at the opposite end by means of a downstream axis return pulley 26. As shown in FIG. 1*b*, the tensioning of the belt 21 is ensured, in the preferred embodiment, by the return pulley 23 which can be moved along a groove 27 so that the length of the obliged path of the belt 21 can be varied. The belt portion 21 delimited by the upstream axis return pulley 24 and the downstream axis return pulley 26 forms an useful portion 28 fixedly attached to the upper guide 14.

In order to improve the support of the plate-like workpieces traveling in the traveling plane 2 in contact with the useful portion 28, a removable supporting bar 30 is arranged which has an upper surface substantially located at the level of the traveling plane 2. This supporting bar is held at the correct height by means of two legs 31 slid into a pair of sleeves 32 which are horizontally slidable between the frames A,B of the folder-gluer, along two crossbars 33 of square section such as illustrated in FIG. 3.

To enable correct guiding of the plate-like workpieces parallel to a longitudinal reference line, which line generally corresponds to the longitudinal machine axis, a removable guiding member 40 is arranged at the height of the traveling plane 2 of the plate-like workpieces against the lower guide 13. According to the illustrations in FIGS. 1*b* and 3. This guiding member 40 is comprised in particular of a support 41 and two posts 42 fixedly attached to the bearing element 11 by means of an easily dismountable fastening member. A longitudinal guiding rail 43 covers the support 41. This longitudinal guiding rail 43, in the present example, is made up of an U-shaped sheet mounted on the support 41 by easily dismountable fastening elements 44, such as screws or knurled knobs. Advantageously, the longitudinal guiding rail has at least one sectional face 45 against which the lateral edge of a plate-like workpiece can rest. Preferably, the longitudinal guiding rail 43 has a sectional face 45, for example a channel-section, and/or an opposite planar face 46. It thus forms an advantageously reversible rule, which, according to the needs, can be fixed on one or the other side of the vertical plane of the lower guide.

It will be noted that the lower aligner 10 does not comprise any pivot point able to vary the angle of the lower conveyor 20 with respect to the guiding member 40. However, this is nevertheless possible in the device of the present invention by the opening 12 of the bearing element 11 and its features. Effectively, this opening is used to weaken the material of this bearing element in order to create a relative flexibility between the two parts which it delimits, namely between the lower guide 13 and the upper guide 14, while remaining within the elastic limits of the material. Thus, owing to the slit structure of the bearing element 11, the lower guide 13 remains fixed, once the device positioned between the frames A, B of the folder-gluer, in a vertical rest plane whereas the upper guide 14, by deflection with respect to the lower guide 13, is movable in the horizontal plane.

In order to block the lower conveyor in an angular so-called work position chosen with respect to the guiding member 40, a setting member 50 allows adjusting and blocking the upper guide 14 with respect to the lower guide 13. To this end, a knurled knob 51 extends through an oblong opening 52, which is transversely arranged in an upper square 54, and is screwed in a lower square 53. The lower 53 and upper 54 squares are arranged back to back and fixedly attached respectively to the lower guide 13 and the upper guide 14. In rest position, namely when the upper guide and the lower guide are in the same vertical plane, the knurled knob 51 is preferably located in the middle of the travel of the setting member 50, namely at half passage of the length of the oblong opening 52.

The upper aligner member 60 will now be described with reference to FIGS. 1*a*, 2*a* and 3. It comprises in particular a bracket 61 comprises of a bent plate used at the same time as a bearing element for an upper conveyor 70 mounted in correspondence with the lower conveyor 20, and as linking member for fixedly attaching this upper conveyor to the bearing element 11 and more particularly to the lower guide 13. To this end, a plurality of bolts 62 extends through the bracket base 61 and are fixed in the holes provided for this purpose in the lower guide 13. The upper conveyor 70 is fixed against the upper part of the bracket 61 by means of its jaw 71 supported at its upper end by screws 72. The opposite end of the jaw 71 is connected by knurled knobs 73 to a longitudinal bar 74 supporting a plurality of pressure rollers 75. These pressure rollers are suspended on return springs (not shown). An angle 76, longitudinally movable, allows to adjust simultaneously the height of the pressure rollers 75 by acting against the force of their return spring and to block the position of these pressure rollers by means of two knurled knobs 77. Thus, this arrangement allows an adjustment of the pressure of the pressure rollers on the subjacent plate-like workpieces.

A removable sheet 80 is arranged against one of the sides of the longitudinal bar 74 and is vertically held by means of two knurled knobs 81. This sheet 80 is folded at its base so as to form a shoe 82 the ends of which are slightly raised. Firstly, this sheet is used as protection, such as a casing, for the uncovered face of the pressure rollers 75, namely the face opposite the one being located on the side of the guiding member 40 when the upper aligner 60 is mounted above the lower aligner as illustrated in FIG. 3. Owing to its shoe 82, this sheet is also used to create an upper support for flattening the plate-like workpieces traveling in the aligning device 1 against the supporting bar 30 or at least preventing their rising. To this end, the shoe 82 and the supporting bar 30 are arranged in correspondence, preferably in the same vertical plane.

Referring to the operation of the aligning device 1, the machine operator firstly determines the configuration right or left to be adopted to carry out the alignment of the plate-like workpieces. This configuration essentially depends on the type of plate-like workpiece to be worked. According to the size of the plate-like workpieces, he adjusts the lateral position of the lower aligner 10 which moves owing to the rotation, manual or motorized, of an endless screw extending through the nut 18 of the bearing element 11. Being rigidly fixed to the lower guide 13 by means of the bracket 61, the upper aligner 60 is advantageously moved during the same operation. Once the device is correctly positioned, the operator then chooses the face of the longitudinal guiding rail 43 which is most appropriate in accordance with the thickness of the plate-like workpieces to be aligned. Effectively, the sectional face 45 is advantageously adapted to thin workpieces whereas the planar face 46 is rather appropriate for aligning thick plate-like workpieces. The adjustment of the angle of deflection of the lower conveyor 20 can be done in one or the other direction so that the plate-like workpieces can be oriented either towards the operator's side or towards the opposite operator's side in accordance with the chosen configuration. In a configuration for a so-called right alignment, the lower conveyor 20 is inclined towards the operator's side and inversely for a so-called left alignment. To this end, it is sufficient to act on the setting member 50 by unscrewing the knurled knob 51 then to push the upstream end of the lower conveyor 20 towards the chosen side in order to remove it from its vertical rest plane, and finally to tighten the knurled knob 51 in order to block the lower conveyor in the chosen angular position. The upper conveyor can then be adjusted so as to be placed in the same vertical plane as the lower conveyor.

In order to inverse the configuration, for example for changing from a configuration for an alignment on the right to a configuration for an alignment on the left, it is sufficient to carry out the succession of the following operations:

To separate the upper aligner 60 from the lower aligner 10 by unscrewing the fastening bolts 62 of the bracket 61.

To lift the supporting bar 30 so as to take it out from its sleeves 32 and to slide it on the other side of the bearing element 11 into a new pair of sleeves 32 provided for this purpose.

To unscrew the guiding member 40 and to rechuck it on the other side of the bearing element 11 on the spacers 47 fixed for this purpose against the lower guide 13 of the bearing element 11.

To turn the sheet 80 of a half-turn in the horizontal plane after having unscrewed the knurled knobs 81, then to rechuck it by screwing these knurled knobs in threads 83 provided for this purpose on the opposite side of the longitudinal bar 74.

To turn the bracket 61 of a half-turn in the horizontal plane after having separated it from the upper conveyor 70 by unscrewing the screws 72, then to rechuck it against the opposite face of the lower guide 13 by means of the bolts 62 and a spacer 64 provided for this purpose.

After having carried out these operations, the aligning device 1 should be moved close to the corresponding frame of the machine. Due to the simple design of this device, such a configuration inversion can easily be realized in only 10 to 15 minutes, without having to move heavy loads and without having to withdraw parts of any transverse axis.

As previously described, the lower conveyor 20 is comprised of a belt 21 and the upper conveyor 70 is comprised of a track of pressure rollers 75.

According to a preferred embodiment, the drive pulley 22 is fixedly attached to the lower guide 13 and the useful portion 28 of the belt 21 is supported by a series of rollers of well-known construction (not shown in the drawings).

Since the first aim of the upper conveyor 70 is to exert a certain pressure onto the plate-like workpieces in order to improve their conveying in contact with the lower conveyor 20, an alternative of the object of the present invention could be to remove the upper aligner 60 and to use only the lower aligner 10 if the adherence of the plate-like workpieces on the lower conveyor is sufficient. Such a case could arise, for example, owing to the arrangement of a suction device which acts in conjunction with the lower conveyor 20.

Once installed in a folder-gluer, the aligning device 1 thus advantageously offers the possibility of aligning plate-like workpieces on one as well as the other side of the machine, in a minimum of time and handling. This feature also has a direct economic advantage since it is not necessary to have two aligning devices, one for the operator's side and the other for the side opposite the operator's side, for efficiently cover the totality of possibilities that a folder-gluer could offer.

In addition to its multi-purpose, this device has also the advantage of being light and of economic design owing to better adapted equipment. In this connection, the features of the guiding member 40 are cited as an example, the longitudinal rail of which is of non-massive design obtained by folding without its geometrical properties, namely its perfect straightness having to suffer. With regard to the milling and grinding of massive bars known from prior art, this embodiment is obvious.

Finally, owing to the single structure formed by the lower guide 13 and the upper guide 14, the manufacture and assembly of the device 1 are greatly simplified, the space requirement of the device can be reduced, the arrangement of its members is facilitated and the guiding of the plate-like workpieces is improved.

Numerous improvements can be applied to the device of the present invention within the scope of the claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for aligning plate-like workpieces traveling in a traveling direction and in a traveling plane of a machine processing the workpieces, the device comprising:

an upper aligner;

a lower aligner positioned below the upper aligner and including a lower guide, a guiding member mounted on the lower guide, and a lower conveyor positioned on the lower aligner, the lower conveyor having at least one guide portion;

the lower aligner further comprising an upper guide movable in a horizontal plane with respect to the lower guide, the at least one guide portion of the lower conveyor being fixed to the upper guide;

the lower guide and upper guide together forming a bearing element formed from a single piece of material having an opening for weakening the bearing element to enable movement of the upper guide.

2. The device according to claim 1, wherein the opening comprises a slit in the bearing element configured to allow angular positioning, in the horizontal plane, of the upper guide with respect to the lower guide of the bearing element in one direction with respect to the traveling direction of the plate-like workpieces or an opposite direction with respect to the traveling direction of the plate-like workpieces; and a setting member operable to adjust the upper guide to a selected angular position and to block the upper guide in the selected angular position with respect to the lower guide.

3. The device according to claim 1, wherein the guiding member is removably mounted on the lower guide of the bearing element.

4. The device according to claim 3, wherein the lower guide includes a left face and a right face, and the guiding member is mounted on the right face of the lower guide of the bearing element with respect to the traveling direction of the plate-like workpieces.

5. The device according to claim 3, wherein the lower guide includes a left face and a right face, and the guiding member is mounted on the left face, with respect to the traveling direction of the plate-like workpieces, of the lower guide of the bearing element.

6. The device according to claim 3, wherein the guiding member comprises a reversible longitudinal guiding rail having at least one of a sectional face and a planar face.

7. The device according to claim 1, wherein the lower aligner comprises a removable supporting bar arranged on a side opposite to a side of the guiding member the supporting bar having an upper surface located at a level of the traveling plane of the plate-like workpieces.

8. The device according to claim 7, further comprising legs slid into sleeves which laterally slide along crossbars arranged between frames of the machine, the legs holding the supporting bar at the level of the traveling plane.

9. The device according to claim 1, wherein the upper aligner includes an upper conveyor mounted in correspondence with the lower conveyor and fixedly attached to the lower guide by a removable bracket.

10. The device according to claim 9, wherein the upper conveyor comprises a plurality of pressure rollers having one face being protected by a removable sheet and the sheet having a base with a shoe arranged in correspondence with a removable supporting bar arranged on a side opposite to a side of the guiding member.

* * * * *